US005957437A

United States Patent [19]

Savenok

[11] Patent Number: 5,957,437

[45] Date of Patent: Sep. 28, 1999

[54] BALUSTRADE AND CONNECTOR COMBINATION

[76] Inventor: Peter Savenok, 25 W. 618 Durfee Rd., Wheaton, Ill. 60187

[21] Appl. No.: 08/910,636

[22] Filed: Aug. 13, 1997

[51] Int. Cl.[6] ..... E04H 17/14

[52] U.S. Cl. ..... 256/65; 256/59

[58] Field of Search ..... 256/65, 68, 59, 256/24, 19; 52/720.2, 585.1; 403/229; 242/590, 598; 16/229

[56] References Cited

U.S. PATENT DOCUMENTS

| | | | |
|---|---|---|---|
| 2,249,329 | 6/1941 | Rosenberg | 16/229 |
| 2,253,398 | 8/1941 | Reifenberg | 16/229 |
| 3,499,631 | 3/1970 | Heldenbrand | 256/59 |
| 3,975,000 | 8/1976 | Sado . | |
| 3,981,112 | 9/1976 | Dake | 52/184 |
| 4,352,485 | 10/1982 | Basey | 256/65 |
| 4,368,875 | 1/1983 | Weiss et al. | 256/65 |
| 4,383,656 | 5/1983 | Campbell | 242/55.2 |
| 4,390,164 | 6/1983 | Cokelekoglu . | |
| 4,505,456 | 3/1985 | Zieg . | |
| 5,340,087 | 8/1994 | Turner . | |
| 5,372,354 | 12/1994 | Cacicedo | 256/65 |
| 5,415,380 | 5/1995 | Sharp | 256/24 |
| 5,573,346 | 11/1996 | Goodwin | 256/65 |

FOREIGN PATENT DOCUMENTS

| | | | |
|---|---|---|---|
| 0138969 | 1/1902 | Germany | 16/229 |
| 0300806 | 9/1917 | Germany | 16/229 |
| 1104539 | 4/1961 | Germany | 16/229 |
| OLS 1950569 | 4/1971 | Germany | 256/65 |

*Primary Examiner*—Brian K. Green
*Assistant Examiner*—Marcus Dolce
*Attorney, Agent, or Firm*—Meroni & Meroni

[57] ABSTRACT

A balustrade connecting structure, the connecting structure is used to connect the rail to a support structure, the connecting structure is constructed to be recessed into an end of a rail to enable the connection of the rail to the support structure, the connecting structure comprises: a housing unit and at least one connecting pin, the connecting pin is slidably attached to the housing unit, the connecting pin has a spring load, the spring load on the connecting pin acts to keep a predetermined portion of the connecting pin protruding from the housing unit, whereby when the connecting pin is pushed into the housing unit the spring load acts to push the predetermined portion of the connecting pin from the housing unit, therefore when the connecting pin is pushed into the housing unit when the housing unit is recessed in the rail, the rail can then be aligned with at least one prealigned hole in the support structure and the spring load on the connecting pin forces the predetermined portion of the connecting pin to engage with the prealigned hole, thereby providing a neatly connected rail of a balustrade to a support structure.

12 Claims, 5 Drawing Sheets

FIG. 7
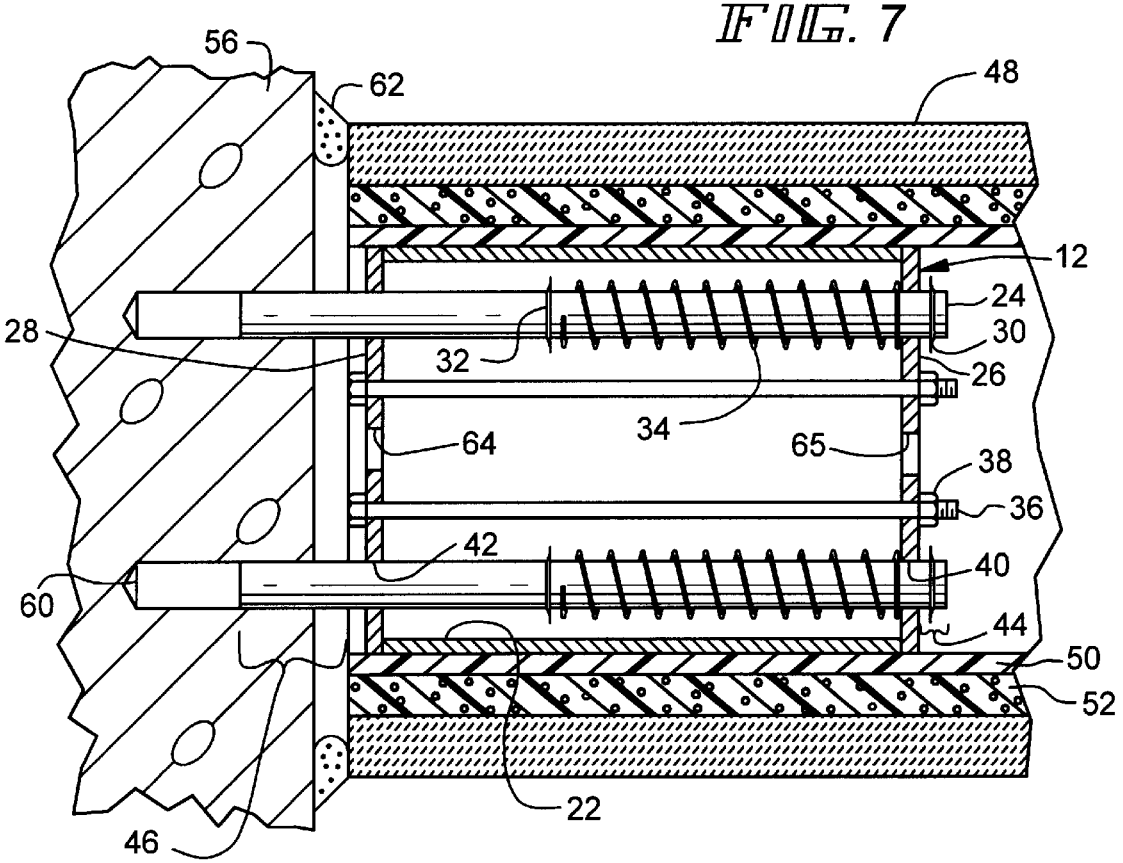
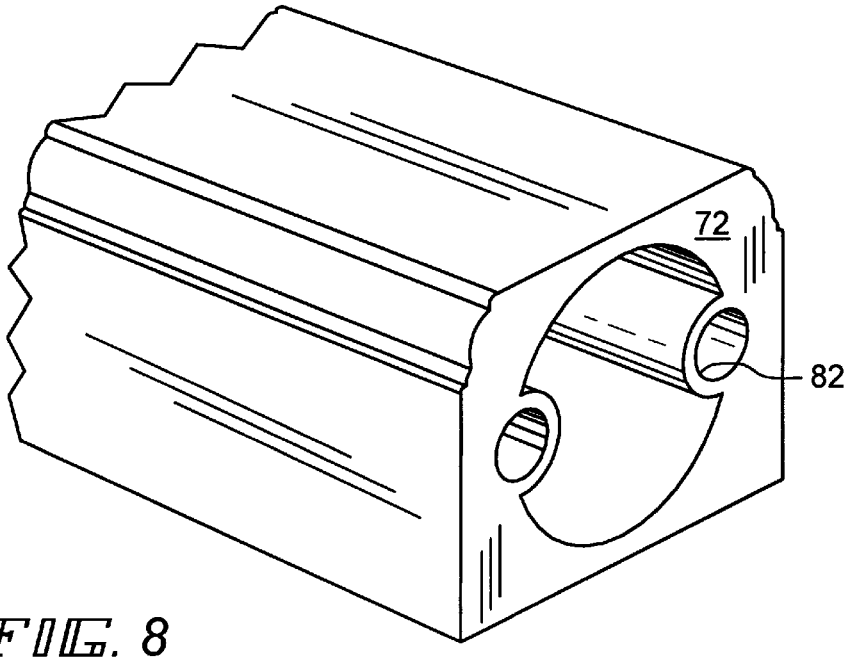
FIG. 8

FIG. 9
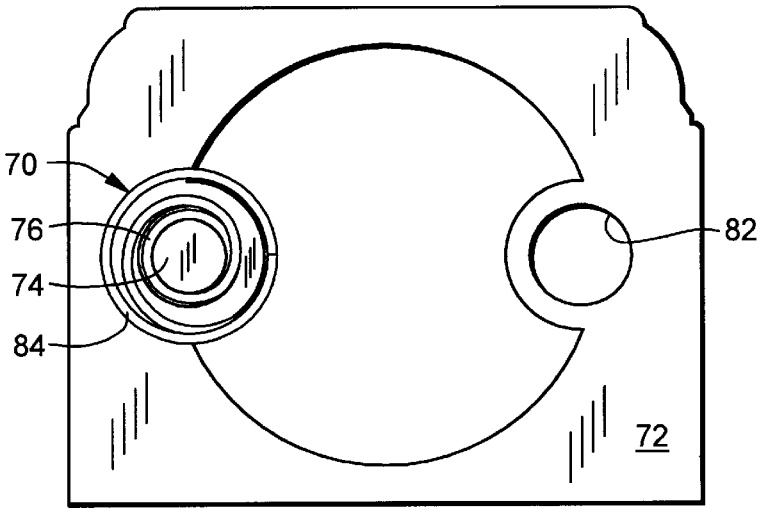
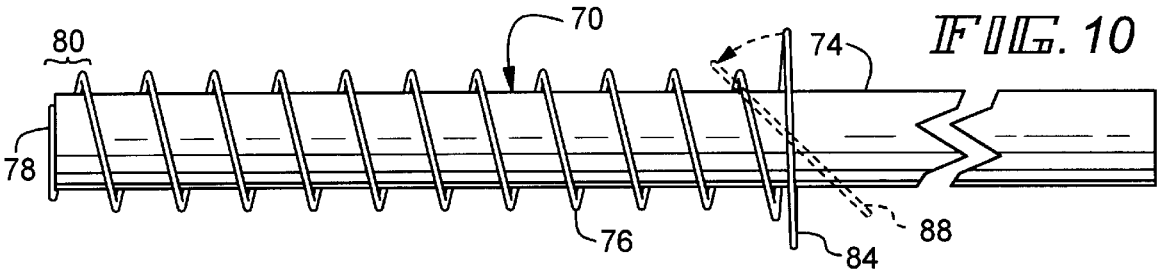
FIG. 10
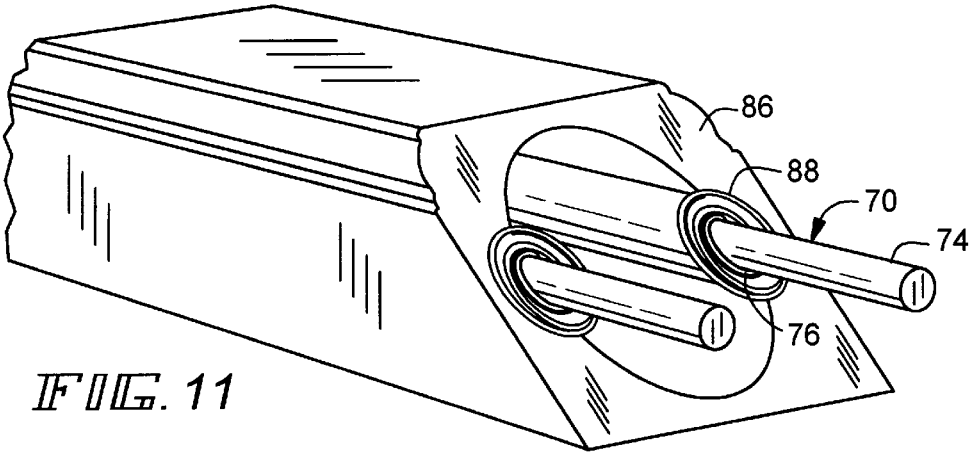
FIG. 11

BALUSTRADE AND CONNECTOR COMBINATION

BACKGROUND OF THE INVENTION

1. Field of the Invention

The present invention relates generally to a new and improved connecting structure for a balustrade and a connector combination. More specifically the present invention provides a connecting structure or a connecting pin that allows a quick and easy connection of a rail of a balustrade with a post or a support structure and also keeping the connecting structure or connecting pin hidden from view.

2. Description of the Prior Art

In the past, it has been the practice to connect rails of balusters to support posts with screws, nuts and bolts, brackets, dowel pins, and even adhesive. The use of screws, nuts and bolts, and brackets result in unsightly holes and/or connectors left on the rail and/or the support post. The use of dowel pins requires one to adhesively secure the dowel pins in place and to measure the exact location of where the holes need to be placed. This method can be time consuming and can result in errors of calculating the location of the holes. Furthermore, the use of adhesive does not allow for the balustrade to be taken apart, if necessary.

There have been various types of connectors available in the marketplace, but none have gained widespread acceptance because of their difficulty of use and inability for quick installation. In addition, other types of connectors require constant readjustment, do not provide adequate support and are not hidden from view.

These and other types of connectors used in the past do not offer the flexibility and inventive features of my balustrade and connector combination. As will be described in greater detail hereinafter, the balustrade and connector combination of the present invention differs from those previously proposed.

SUMMARY OF THE INVENTION

According to my present invention I have provided a balustrade connecting structure, the connecting structure is used to connect the rail to a support structure, the connecting structure is constructed to be recessed into an end of a rail to enable the connection of the rail to the support structure, the connecting structure comprises: a housing unit and at least one connecting pin, the connecting pin is slidably attached to the housing unit, the connecting pin has a spring load, the spring load on the connecting pin acts to keep a predetermined portion of the connecting pin protruding from the housing unit, whereby when the connecting pin is pushed into the housing unit the spring load acts to push the predetermined portion of the connecting pin from the housing unit, therefore when the connecting pin is pushed into the housing unit when the housing unit is recessed in the rail, the rail can then be aligned with at least one prealigned hole in the support structure and the spring load on the connecting pin forces the predetermined portion of the connecting pin to engage with the prealigned hole, thereby providing a neatly connected rail of a balustrade to a support structure.

I have further provided a balustrade connector as described above wherein the housing unit is a tubular housing, the tubular housing has a pair of open ends opposite each other, the connecting structure further includes a first cover plate and a second cover plate, the first cover plate and the second cover plate are attached to the tubular housing at opposing ends covering the pair of open ends. The first cover plate and the second cover plate have at least one pin hole, the pin holes are positioned in coaxial alignment across an inner portion of the tubular housing. The connecting pin has a first pin end and a second pin end, the connecting pin has a length longer than a length of the tubular housing, the connecting pin has a diameter slightly smaller than the size of the pin holes so as to allow the connecting pin to freely slide within the pin holes. The connecting pin extends transversely through the coaxially aligned pin holes across the inner portion of the tubular housing, wherein the first pin end extends outside of the pin hole of the first cover plate and the second pin end extends outside of the pin hole of the second cover plate. The connecting pin includes a stop structure, a spring, and a spring retaining structure. The stop structure is connected to the first pin end, the stop structure prohibits the first pin end from fully entering the inner portion of the tubular housing and allows the second pin end to extend outside of the pin hole of the second cover plate a predetermined maximum protruding distance. The predetermined maximum protruding distance of the second pin end has a length less than a length of the tubular housing, the spring has an uncompressed length less than the length of the tubular housing and longer than the predetermined maximum protruding distance. The spring has a diameter larger than the connecting pin and is positioned about the connecting pin within the tubular housing, the spring further has a diameter larger than the pin hole on the first cover plate, thereby allowing the connecting pin to freely slide within the diameter of the spring and prohibiting the spring from exiting the pin hole of the first cover plate. The spring retaining structure is secured to the connecting pin within the tubular housing, the spring retaining structure prohibits the spring from moving past the spring retaining structure. The spring retaining structure is positioned on the connecting pin so as to allow the spring to be only slightly compressed when the second pin end extends the predetermined maximum protruding distance from the pin hole of the second cover plate.

Still another feature of my invention concerns the balustrade connector described above, wherein the second cover plate has a finger hole, the finger hole is sized to enable a user to place a finger within the finger hole so as to enable a user to grasp the connecting structure by using the finger hole.

Still yet another feature of my invention concerns the balustrade connector described above, wherein each of the cover plates have a wire hole, the wire hole is sized to enable wires to run through the balustrade connector.

Yet another feature of my invention concerns the balustrade connector as described above, wherein the stop structure and the spring retaining structure are push nuts, each of the push nuts comprise a washer which has an inner diameter and an outer diameter, the inner diameter of the washer is substantially equivalent to the diameter of the connecting pin, wherein when the push nuts are placed onto the connecting pin, the inner diameter of the washer tightly abuts the diameter of the connecting pin and prohibits the washer from moving along the length of the connecting pin.

A still further feature of my invention concerns the balustrade connector as described above, wherein the first cover plate and the second cover plate are attached to the tubular housing with at least one bolt and at least one nut attached to an end of the bolt, wherein the bolt extends through the first cover plate, the second cover plate and through the inner portion of the tubular housing.

An even further feature of my invention concerns the balustrade connector as described above, wherein the connecting structure has two connecting pins.

Yet still another feature of my invention concerns the balustrade connector as described above, wherein the rail and the supporting structure are joined together with the connecting structure as a mitered joint, or wherein the end of the rail is angled to enable the connection of an angled rail to a vertical supporting structure.

According to other features in invention I have provided a balustrade connecting pin used in connecting a rail of a balustrade to a support structure, the connecting pin is constructed to be recessed into a prealigned hole at an end of the rail to enable the connection of the rail to a complementary aligned hole in the support structure, the connecting pin comprises: a rod and a spiral spring, the spiral spring has an uncompressed length less than the length of the rod. The spiral spring has a diameter larger than the rod and is positioned about the rod, the spiral spring has a stop tightly secured at a first end to prohibit the rod from passing past the first end of the spiral spring but allows the rod to freely slide within the diameter of the spiral spring. The diameter of the spiral spring is less than a diameter of a prealigned hole at the end of a rail to allow the spiral spring to freely move within the prealigned hole, the spiral spring has a flange at a second end, the flange has a diameter greater than the diameter of the prealigned hole at the end of the rail, whereby when the rod is pushed into the prealigned hole the flange prohibits an upper portion of the spiral spring from being pushed into the prealigned hole and the stop on the spiral spring acts to stretch the spiral spring within the prealigned hole, the rail can then be aligned with a complementary aligned hole in a support structure and a spring load from the stretched spiral spring acts to forces a portion of the rod to engage with the complimentary aligned hole, thereby providing a neatly connected rail of a balustrade to a support structure.

Still another feature of my invention concerns the connecting pin as described above, wherein the stop at the first end of the spiral spring is an inwardly coiled wire extending from the first end of the spiral spring.

Yet another feature of my invention concerns the connecting pin as described above, wherein the flange at the second end of the spiral spring is an annular outwardly coiled wire extending from the second end of the spiral spring.

A further feature of my invention concerns the connecting pin as described above, wherein the flange at the second end of the spiral spring is angled to enable the connecting pin to be used on an angled joint.

Other objects, features and advantages of my invention will become more readily apparent upon reference to the following description when taken in conjunction with the accompanying drawings, which drawings illustrate several embodiments of my invention.

DESCRIPTION OF THE DRAWINGS

FIG. 7 is a partial cross-sectional side view illustrating how my connecting structure connects a rail to a wall;

FIG. 8 is a partial perspective view of a preformed rail used to connect the rail to a post or a wall embodying further important features of my invention;

FIG. 9 is an end view of the preformed rail shown in FIG. 8 with my connecting pin in place;

FIG. 10 is a fragmentary side view of my connecting pin illustrating important features of my invention; and FIG. 11 is a partial perspective view illustrating how my connecting pins are used with a mitered rail.

DETAILED DESCRIPTION OF THE PREFERRED EMBODIMENT

Figure 1:
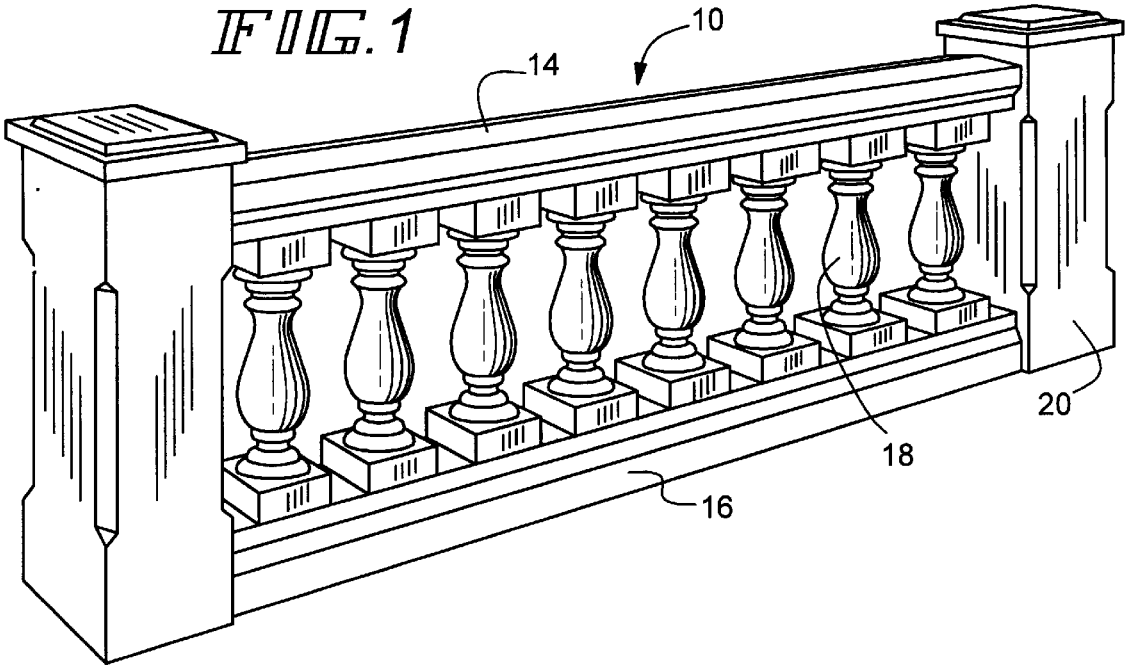
FIG. 1 is a perspective view of a balustrade secured to a pair of posts in accordance with important features of my invention.
Figure 2:
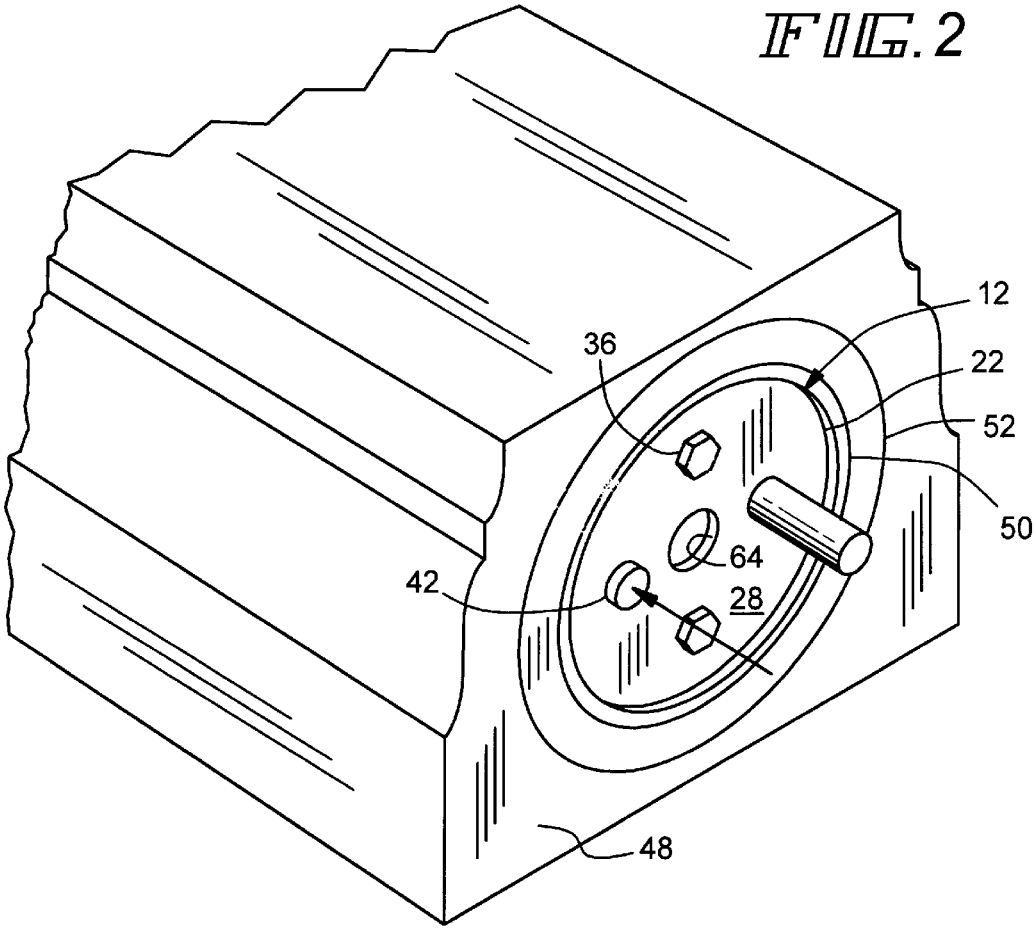
FIG. 2 is a partial perspective view illustrating how my connecting structure is used in connecting rails to a post.
Figure 3:
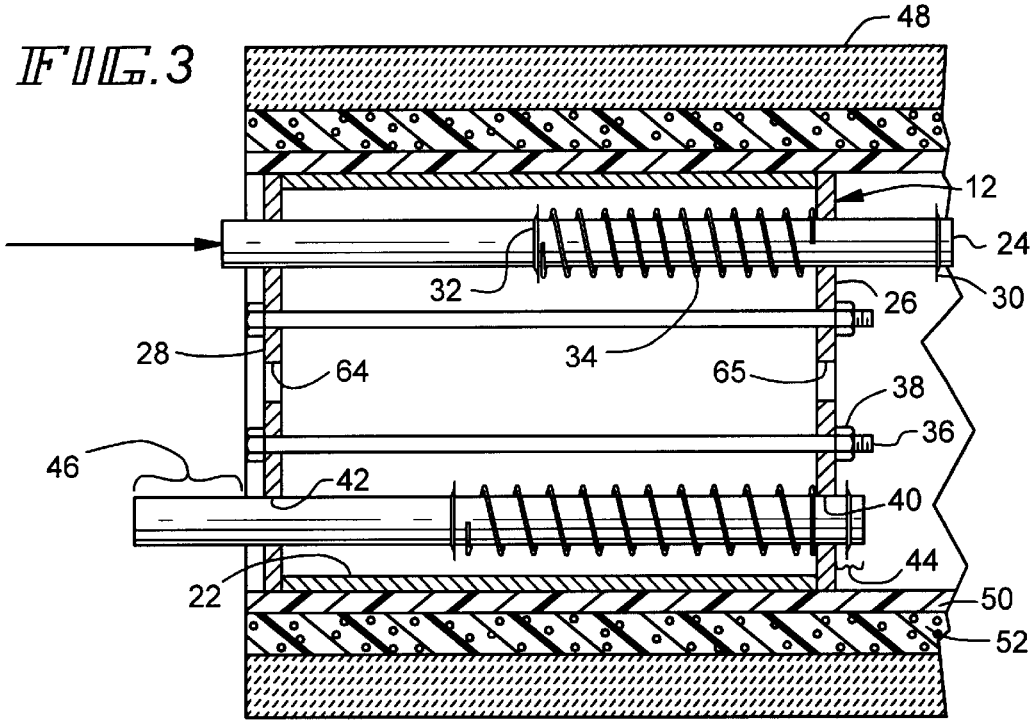
FIG. 3 is a partial cross-sectional side view illustrating how my connecting structure is used in conjunction with a rail.
Figure 4:
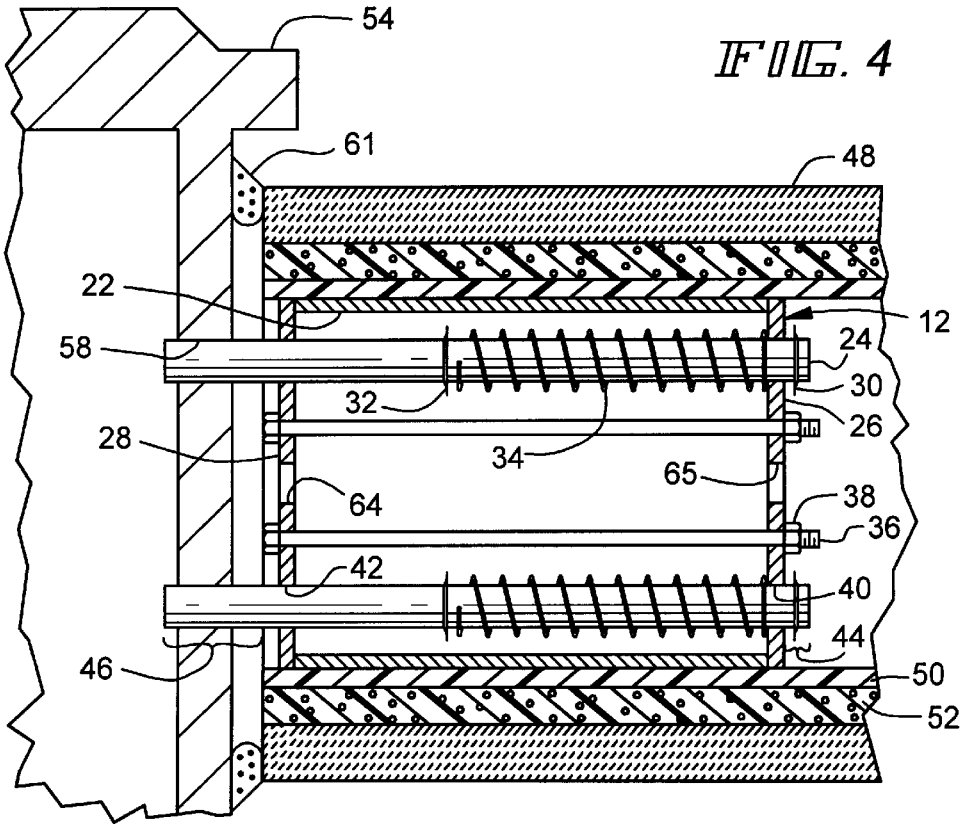
FIG. 4 is a partial cross-sectional side view illustrating how my connecting structure connects a rail to a post.
Figure 5:
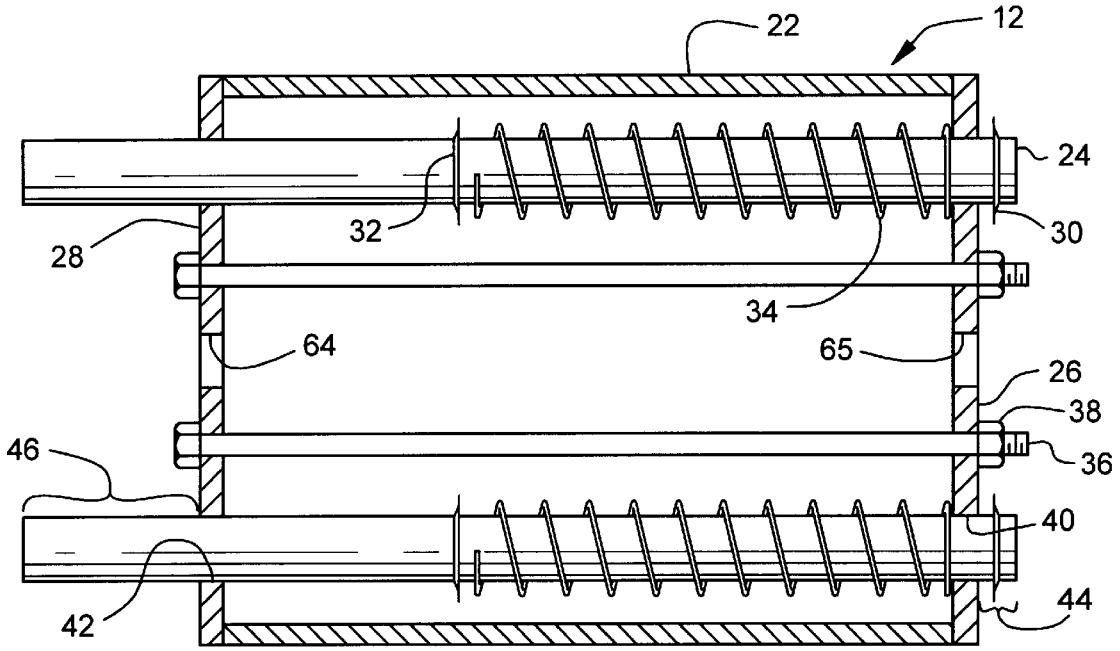
FIG. 5 is a cross-sectional side view of my connecting structure illustrating important features of my invention.
Figure 6:
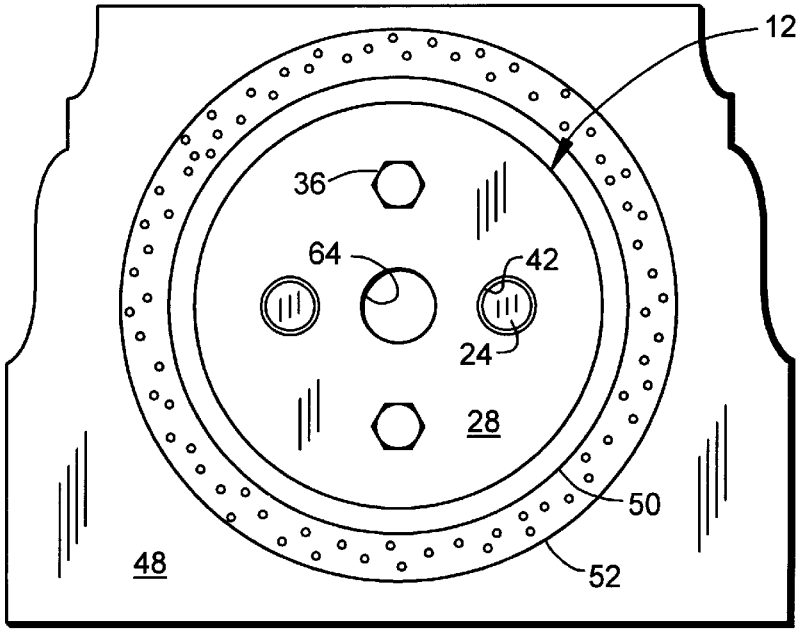
FIG. 6 is an end view of my connecting structure attached at the end of a rail.

Referring now to the drawings, FIG. 1 shows a balustrade 10 that can be used with my new and improved balustrade connecting structure or balustrade connector 12 shown in FIGS. 2–7. The balustrade 10 comprises of an upper rail or handrail 14, a lower rail or base rail 16, a plurality of balusters 18 connected in between the rails, and a supporting post structure 20.

The balustrade connector 12 shown in FIGS. 2–7 is designed to quickly and easily connect the rails 14, 16 to the supporting post structure 20, while keeping the balustrade connector hidden within the ends of the rails. The balustrade connector is designed to be of such size so as to be recessed into an end of a rail to enable the connection of the rail to an opposite supporting surface, such as an upright post, a wall, or a brick layered surface.

The balustrade connector 12 is comprised of a housing unit or a tubular housing 22, at least one connecting pin 24, a first cover plate 26, a second cover plate 28, a stop structure 30, a spring retaining structure 32, a spring 34, and a cover plate holding structure, such as a bolt 36 and a nut 38.

The tubular housing 22 has a pair of open ends opposite each other. This housing is designed to have a diameter small enough in size to be recessed into an end of a rail. Since rails can come in varying sizes, the tubular housing can be made of varying diameters to accommodate the size of rail used. The tubular housing can be constructed of various types of rigid materials including, but not limited to, plastic, PVC, and metal.

The cover plates 26, 28 are attached to the tubular housing 22 at opposing ends covering each open end. The cover plates have at least one pin hole 40, 42 for allowing the connecting pin 24 to freely slide within the pin hole. The pin holes on the cover plates 26, 28 are positioned in coaxial alignment across the inner portion of the tubular housing 22 to allow a straight horizontal movement of the connecting pin 24 through the housing. The cover plates can be constructed of various types of rigid materials including, but not limited to, plastic, PVC, and metal. In the Figures, the cover plates are held in place with a bolt 36 and a nut 38. The bolt 36 extends through the first and second cover plate and across the inner portion of the tubular housing 22, and is securely fastened by a nut 38 on the outside of the first cover plate 26. Various other methods can be used to secure the cover plates to the tubular housing, including, but not limited to clips and adhesive.

It is not critical that the connecting structure 12 be constructed with the exact parts described earlier, however, it is critical for the connecting structure to allow the spring loaded movement of connecting pins in and out of the connecting structure.

The connecting pin has a first pin end 44, and a second pin end 46. The connecting pin 24 has a length longer than the length of the tubular housing 22, and has a diameter slightly smaller than the diameter of the pin holes 40, 42. This allows the connecting pin 24 to freely slide within the pin holes. The connecting pin is positioned to extend transversely through the coaxially aligned pin holes across the inner portion of the tubular housing 22. The first pin end 44 is positioned to extend outside of the pin hole 40 of the first cover plate 26, and the second pin end 46 is positioned to extend outside of the pin hole 42 of the second cover plate 28. The connecting pin can be constructed of various types of rigid materials including, but not limited to, plastic, PVC, and metal. Excellent results in connecting the rail and the supporting post structure can be obtained when to connecting pins are used, as shown in the Figures.

The stop structure or push nut 30 is tightly connected to the connecting pin 24 at the first pin end 44. The push nut 30 is basically comprised of a washer. The inner diameter of the washer is substantially equivalent to the diameter of the connecting pin 24, wherein when the push nut 30 is placed onto the connecting pin 24, the inner diameter of the washer tightly abuts the diameter of the connecting pin and prohibits the washer from moving along the length of the connecting pin. Many different types of stop structures can be used, one such stop structure of using a push nut is herein disclosed. The main feature of the stop structure 30 is to prohibit the first pin end 44 from passing through the first pin hole 40.

The push nut 30 allows the second pin end 46 to extend outside of the second cover plate 28 a maximum predetermined protruding distance. Excellent results can be obtained when the maximum protruding distance is 4 to 6 inches. The connecting pin is designed so that the maximum protruding distance of the second pin end is less than the length of the tubular housing 22, otherwise the connecting pin 24 cannot be pushed into the tubular housing wherein the end of the second pin end 46 can be flush with the second cover plate 28.

The spring 34 is positioned about the connecting pin 24 within the tubular housing 22 in a spiral fashion. The spring 34 has an uncompressed length less than or equal to the length of the tubular housing and is longer than the maximum predetermined protruding distance of the connecting pin 24. The spring has a diameter slightly larger than the connecting pin in order to allow the connecting pin 24 to freely slide within the diameter of the spring 34. The spring is designed to also have a diameter slightly larger than the pin hole 40 on the first cover plate to prohibit the spring from passing through the pin hole. It is possible to have a spring with a diameter smaller than the pin hole 40, however, a retainer, such as a washer, would need to be used to prohibit the spring from exiting the pin hole.

The spring retaining structure 32 is similar to the stop structure 30, however, the spring retaining structure is secured to the connecting pin 24 within the tubular housing 22. The spring retaining structure 32 is positioned to keep the spring between the spring retaining structure 32 and the first cover plate 26. The spring retaining structure 32 is used to keep the spring 34 in place and to exert a spring loaded force on the connecting pin 24 to push the second pin end 46 a maximum protruding distance beyond the pin hole 42 on the second cover plate 28. Excellent results can be obtained when the spring retaining structure 32 is positioned on the connecting pin 24 such that when the spring 34 is only slightly compressed, the second pin end 46 extends a maximum protruding distance beyond the pin hole 42 on the second cover plate 28.

The balustrade connector 12 is recessed into a hole in a rail 48. The hole can be either preformed or made on the work site. Excellent results can be obtained when using a balustrade made of preformed marble, polyesther resins casted into preformed molds, synthetic plastic or even wood, however, other types of balustrades can also be used. The balustrade connector 12 is placed and sealed with a gasket 50 and/or a sealant 52 within the hole. The gasket 50 can be a PVC pipe or a rubber seal. Excellent results can be obtained when the sealant is a PVC cement while using a tubular housing made of PVC, or the sealant can also be a high density polyurethane foam.

When connecting the rail 48 to a supporting post structure 54 (FIG. 4) or a wall 56 (FIG. 7), the supporting structures 54, 56 require prealigned holes 58, 60 positioned in the location where the connecting pins 24 are to enter. The connecting pins 24 (namely the second pin ends 46) are pushed into the tubular housing 22 and while recessed within the housing the rail 48 is positioned against the supporting structures 54, 56. The rail 48 is moved about along the supporting structures until the connecting pins 24 come into mating engagement with the prealigned holes 58, 60. Due to the spring loaded force on the connecting pins, the second pin ends 46 on the connecting pins 24 enter the prealigned holes and lock the rail into place against the supporting structures 54, 56. Once the rail 48 is set into place, a caulk 61, 62 can be used to seal any gap left between the rail and the supporting structures 54, 56.

In order to make it easier to install the balustrade connector within the rail 48, the second cover plate 28 can have a finger hole or wire hole 64 (FIGS. 2 and 6) positioned thereon. The finger hole is sized to enable a user to place a finger within the finger hole so as to enable a user to grasp the connecting structure 12 with their fingers by using the finger hole.

Many times when balustrades are installed, electrical wires are run through the balustrade rails. These electrical wires can be used for lighting or any other necessary electrical needs. The first and second cover plates 26, 28 can have wire holes 64, 65 so as to enable wires to pass through the balustrade connector.

If one desires to take apart the balustrade and remove the rail 48 from the supporting structure 54, 56, the caulk 61, 62 needs to be removed and then a thin tool can be inserted into the gap to engage the connecting pins 24 to push the extending portions into the tubular housing, thereby allowing the removal of the rail from the supporting structures.

The balustrade connector can also be used to connect angled or mitered joints. This would require to have a connecting structure that has an angled face (not shown) and would work in the same fashion as earlier described. This type of angled connector allows the connection of an angled rail having an angled end to connect to an angled or vertical supporting structure.

Another type of similar connector that can be used to connect a rail to a supporting structure is shown in FIGS. 8–11. This balustrade connector or connecting pin 70 is constructed to be recessed into a prealigned hole at an end of a rail 72 to enable the connection of the rail to a complementary aligned hole in the support structure. The connecting pin 70 is comprised of a rod 74 and a spiral spring 76. The spiral spring 76 has an uncompressed length less than the length of the rod 74. The spiral spring 76 has a diameter larger than the rod and is positioned about the rod. The spiral spring 76 has a stop 78 secured at a first end 80 to prohibit the rod 74 from passing past the first end of the spiral spring, but allows the rod to freely slide within the diameter of the spiral spring. The diameter of the spiral spring 76 is designed to be less than a diameter of a prealigned hole 82 at the end of a rail 72 in order to allow the spiral spring to freely move within the prealigned hole 82. The spiral spring 76 has a flange 84 at a second end. The flange 84 has a diameter greater than the diameter of the prealigned hole 82 positioned at the end of the rail 72.

When the rod 74 is pushed into the prealigned hole 82 after the connector 70 has been placed in the prealigned hole 82, the flange 84 prohibits an upper portion of the spiral spring 76 from being pushed into the prealigned hole and the stop 78 on the spiral spring acts to stretch the spiral spring within the prealigned hole. The rail 72 can then be aligned with a complementary aligned hole in a support structure and a spring load from the stretched spiral spring acts to forces a portion of the rod 74 to engage with the complimentary aligned hole. This allows for a neatly connected rail of a balustrade to a support structure. The stop 78 holds on to the first end 80 of the rod 74 and keeps the rod from disengaging from within the spiral spring and further keeps the rod from leaving the prealigned hole. This type of connector 70 can be used with preformed rails, or with rails that are too small to accommodate the connecting structure 12 shown in FIGS. 2–7.

The stop 78 at the first end 80 of the spiral spring 76 is an inwardly coiled wire extending from the first end of the spiral spring. The stop 78 further pinches the rod to securely fasten the spiral spring to the rod. The flange 84 at the second end of the spiral spring 76 is an annular outwardly coiled wire extending from the second end of the spiral spring. Various different methods can be used to create a stop or a flange on the spiral spring, including, but not limited to securing a plate to the spring to act as a stop or securing a washer to the other end of the spring to act as a flange.

This connecting pin 70 can also be used on a rail 86 (FIG. 11) having an angled edge. In order to use the connecting pin 70 with an angled rail edge, the flange 84 on the spiral spring 76 is angled 88 to enable the connecting pin to be used on an angled or mitered joint. This connecting pin 70 also allows one to remove the rail from the supporting structure by using a thin tool as similarly described earlier.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a balustrade connecting structure, a rail of a balustrade, and a support structure, said connecting structure being used to connect the rail to the support structure, the connecting structure being constructed to be recessed into an end of the rail to enable the connection of the rail to the support structure, the connecting structure comprising:

a housing unit and at least one connecting pin, said connecting pin being slidably attached to the housing unit, said connecting pin having a spring load, said spring load on the connecting pin acting to keep a predetermined portion of the connecting pin protruding from the housing unit, whereby when said connecting pin is pushed into said housing unit the spring load acts to push the predetermined portion of the connecting pin from the housing unit, therefore when the connecting pin is pushed into the housing unit when the housing unit is recessed in the rail, the rail can then be aligned with at least one prealigned hole in the support structure and the spring load on the connecting pin forces the predetermined portion of the connecting pin to engage with the prealigned hole, thereby neatly connecting the rail of the balustrade to the support structure;

wherein said housing unit is a tubular housing, said tubular housing having a pair of open ends opposite each other, said connecting structure further including a first cover plate and a second cover plate, said first cover plate and said second cover plate being attached to the tubular housing at opposing ends covering said pair of open ends, said first cover plate and said second cover plate having at least one pin hole sized smaller than said first and second cover plates, said pin holes being positioned in coaxial alignment across an inner portion of said tubular housing, said connecting pin having a first pin end and a second pin end, said connecting pin having a length longer than a length of the tubular housing, said connecting pin having a diameter slightly smaller than an inner diameter of the pin holes so as to allow the connecting pin to freely slide within the pin holes, said connecting pin extending transversely through the pin holes across the inner portion of the tubular housing, wherein said first pin end extends outside of the pin hole of the first cover plate and said second pin end extends outside of the pin hole of the second cover plate, said connecting pin further including a stop means, and a spring retaining means, said stop means being connected to the first pin end, said stop means prohibiting the first pin end from fully entering the inner portion of the tubular housing and allowing the second pin end to extend outside of the pin hole of the second cover plate defining the predetermined portion, said predetermined portion having a length less than a length of the tubular housing, said spring having an uncompressed length less than the length of the tubular housing and longer than the predetermined portion, said spring load including a spring, the spring having a diameter larger than the diameter of the connecting pin and being positioned about the connecting pin within the tubular housing, said diameter of the spring being larger than the inner diameter of the pin hole on the first cover plate, thereby allowing the connecting pin to freely slide within the diameter of the spring and prohibiting the spring from exiting the pin hole of the first cover plate, said spring retaining means being secured to the connecting pin within the tubular housing, said spring retaining means prohibiting the spring from moving past the spring retaining means, said spring retaining means being positioned on the connecting pin so as to allow the spring to be only slightly compressed when said second pin end extends the predetermined portion from the pin hole of the second cover plate.

2. The combination of claim 1, wherein said second cover plate has a finger hole, said finger hole being sized to enable a user to place a finger within the finger hole so as to enable a user to grasp the connecting structure by using the finger hole.

3. The combination of claim 1, wherein said first cover plate has a first wire hole and said second cover plate has a second wire hole, said first and second wire holes being sized to enable wires to be passed through the balustrade connecting structure.

4. The combination of claim 1, wherein said stop means and said spring retaining means are push nuts, each of said push nuts comprising a washer having an inner diameter and an outer diameter, said inner diameter of said washer being substantially equivalent to the diameter of the connecting pin, wherein when said push nuts are placed onto said connecting pin, the inner diameter of the washer tightly abuts the diameter of the connecting pin and prohibits the washer from moving along the length of the connecting pin.

5. The combination of claim 1, wherein said first cover plate and said second cover plate are attached to the tubular housing with at least one bolt and at least one nut attached to an end of the bolt, wherein said bolt extends through the first cover plate, the second cover plate and through the inner portion of the tubular housing.

6. A balustrade connecting structure used in connecting a rail of a balustrade to a support structure, the connecting structure being constructed to be recessed into an end of the rail to enable the connection of the rail to the support structure, the connecting structure comprising:

a tubular housing, said tubular housing having a pair of open ends opposite each other;

a first cover plate and a second cover plate, said first cover plate and said second cover plate being attached to the tubular housing at opposing ends covering said pair of open ends, said first cover plate and said second cover plate having at least one pin hole sized smaller than said first and second cover plates, said pin holes being positioned in coaxial alignment across an inner portion of said tubular housing;

at least one connecting pin, said connecting pin having a first pin end and a second pin end, said connecting pin having a length longer than a length of the tubular housing, said connecting pin having a diameter slightly smaller than an inner diameter of the pin holes so as to allow the connecting pin to freely slide within the pin holes, said connecting pin extending transversely through the pin holes across the inner portion of the tubular housing, wherein said first pin end extends outside of the pin hole of the first cover plate and said second pin end extends outside of the pin hole of the second cover plate;

a stop means, said stop means being connected to the first pin end, said stop means prohibiting the first pin end from fully entering the inner portion of the tubular housing and allowing the second pin end to extend outside of the pin hole of the second cover plate a predetermined maximum protruding distance, said predetermined maximum protruding distance having a length less than the length of the tubular housing;

a spring, said spring having an uncompressed length less than the length of the tubular housing and longer than the predetermined maximum protruding distance, said spring having a diameter larger than the diameter of the connecting pin and being positioned about the connecting pin within the tubular housing, said spring further having a diameter larger than the inner diameter of the pin hole on the first cover plate, thereby allowing the connecting pill to freely slide within the diameter of the spring and prohibiting the spring from exiting the pin hole of the first cover plate; and a spring retaining means, said spring retaining means being secured to the connecting pin within the tubular housing, said spring retaining means prohibiting the spring from moving past the spring retaining means, said spring retaining means being positioned on the connecting pin so as to allow the spring to be only slightly compressed when said second pin end extends the predetermined maximum protruding distance from the pin hole of the second cover plate, whereby when the second pin end is pushed into the tubular housing when the connecting structure is recessed in the rail, the rail can then be aligned with at least one prealigned hole in a support structure and the spring action on the connecting pin forces the second pin end to engage with a prealigned hole, thereby neatly connecting the rail of the balustrade to the support structure.

7. The balustrade connecting structure of claim 6, wherein said second cover plate has a finger hole, said finger hole sized to enable a user to place a finger within the finger hole so as to enable a user to grasp the connecting structure by using the finger hole.

8. The balustrade connecting structure of claim 6, wherein said first cover plate has a first wire hole and said second cover plate has a second wire hole, said first and second wire holes being sized to enable wires to be passed through the balustrade connecting structure.

9. The balustrade connecting structure of claim 6, wherein said stop means and said spring retaining means are push nuts, each of said push nuts comprising a washer having an inner diameter and an outer diameter, said inner diameter of said washer being substantially equivalent to the diameter of the connecting pin, wherein when said push nuts are placed onto said connecting pin, the inner diameter of the washer tightly abuts the diameter of the connecting pin and prohibits the washer from moving along the length of the connecting pin.

10. The balustrade connecting structure of claim 6, wherein said first cover plate and said second cover plate are attached to the tubular housing with at least one bolt and at least one nut attached to an end of the bolt, wherein said bolt extends through the first cover plate, the second cover plate and through the inner portion of the tubular housing.

11. The balustrade connecting structure of claim 6, wherein said connecting structure has two connecting pins.

12. The balustrade connecting structure of claim 6, wherein an end of said connecting structure is angled to enable the connecting structure to be used on an angled joint.

* * * * *

Disclaimer 5,957,437—Peter Savenok, Wheaton, Ill. BALUSTRADE AND CONNECTOR COMBINATION. Patent dated Jan. 28, 2011. Disclaimer filed Jan. 25, 2011, by the inventor Peter Savenok.

Hereby enters this disclaimer to all claims of said patent.

(*Official Gazette* May 24, 2011)

Disclaimer

5,957,437 — Peter Savenok, Wheaton, IL (US). BALUSTRADE AND CONNECTOR COMBINATION. Patent dated September 28, 1999. Disclaimer filed January 25, 2011, by the owner, Peter Savenok.

Hereby disclaims the patent and its claims in entirety.

(*Official Gazette, March 27, 2012*)